US007520673B2

(12) United States Patent
Bonke

(10) Patent No.: US 7,520,673 B2
(45) Date of Patent: Apr. 21, 2009

(54) ELASTIC DRAWSTRING HAVING IMPROVED MODULUS AND IMPROVED TENSILE YIELD FOR USE ON A PLASTIC LINER BAG

(75) Inventor: Douglas D. Bonke, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 609 days.

(21) Appl. No.: 11/080,796

(22) Filed: Mar. 14, 2005

(65) Prior Publication Data

US 2006/0204716 A1 Sep. 14, 2006

(51) Int. Cl.
*B65D 33/24* (2006.01)
*B65D 33/16* (2006.01)
*B65D 33/28* (2006.01)
*B65D 25/14* (2006.01)

(52) U.S. Cl. ..... 383/43; 383/62; 383/75; 220/495.11

(58) Field of Classification Search ..... 383/72, 383/75, 33, 43, 62; 220/495.11
See application file for complete search history.

(56) References Cited

U.S. PATENT DOCUMENTS 3,010,640 A * 11/1961 Kugler ..... 383/75
3,889,872 A * 6/1975 Lin ..... 383/71
4,792,241 A * 12/1988 Broderick et al. ..... 383/75
4,813,792 A * 3/1989 Belmont et al. ..... 383/75
5,133,607 A * 7/1992 Bonke ..... 383/75
5,265,962 A * 11/1993 Ogawa et al. ..... 383/75
2005/0063622 A1* 3/2005 Kannabiran ..... 383/75

* cited by examiner

*Primary Examiner*—Jes F Pascua
(74) *Attorney, Agent, or Firm*—Merchant & Gould P.C.

(57) ABSTRACT

An elastic drawstring for use in a plastic liner bag is disclosed. The drawstring is elongated and then relaxed to secure the top of the bag to a receptacle and subsequently used to close the bag when filled. The drawstring is formed from an elastomeric polyolefin, preferably a linear low density polyethylene, and contains material comprising polypropylene. The polypropylene addition provides the drawstring with improved modulus or stiffness and improved tensile yield. Improving these properties gives the drawstring a stronger holding force for maintaining the bag in the receptacle and in a closed position when the bag is removed from the receptacle. In addition, the top of the bag has perfed notches at each side that break away to expose the ends of the elastic drawstrings when the consumer stretches the drawstrings around the top of the receptacle. These perfed notches allow for easier manufacturing of the bag.

9 Claims, 3 Drawing Sheets

ELASTIC DRAWSTRING HAVING IMPROVED MODULUS AND IMPROVED TENSILE YIELD FOR USE ON A PLASTIC LINER BAG

FIELD OF THE INVENTION

The present invention relates to plastic bags which are used as liners for waste receptacles, and more particularly to an integral elastic drawstring that provides a stronger holding force for maintaining the bag in the receptacle and in a closed position when the bag is removed from the receptacle.

BACKGROUND OF THE INVENTION

In order to maintain sanitary conditions, plastic bags have been used to line waste receptacles in both institutional and commercial practice. The plastic liner bag prevents waste or other materials from contacting the receptacle, as well as providing a simple and easy way to empty the container.

Because of the large variety of container sizes, it is difficult to secure the bag to the container so that it will not slide down into the receptacle. Merely folding the top of the bag over the receptacle is not satisfactory, since the materials in the bag tend to pull the bag into the receptacle.

U.S. Pat. No. 4,509,570 describes a plastic bag which has an elastic loop positioned in the hem at the top of the bag. The elastic loop provides a means to hold the bag at the top of the receptacle as well as to close the bag when it is removed from the receptacle. The elastic loop is in a highly stretched state when the bag is open and closes the top of the bag automatically when removed from the receptacle. It is difficult and expensive to manufacture a bag with the elastic band in a highly stretched state. Further, a bag having the automatic closing feature of this patent can provide a safety hazard to a child who may inadvertently obtain one of the bags and place the bag over his head. A bag having a similar elastic top is found in French Patent No. 1,419,805.

In U.S. Pat. No. 4,747,701, a plastic liner bag is described which has an elastic band partially secured to the open top of the plastic bag. The plastic band is used to overlap the top of a receptacle to hold the bag in place on the receptacle. This band can not be used as a drawstring to close the top of the bag when it is filled. French Patent No. 1,367,590 also describes a bag having an elastic top which does not act as a drawstring.

U.S. Pat. No. 4,802,582 describes a typical drawstring trash bag. The drawstring of this patent is not elastic.

In U.S. Pat. No. 4,792,241 the drawstring of the bag has a circumference less than that of the bag, but the drawstring is not elastic.

U.S. Pat. No. 4,938,607 utilizes a drawstring in forming a plastic sheet that can be used to produce a container for yard clippings and the like. The outer dimensions of the drawstring are smaller than the outer dimensions of the plastic sheet, but the drawstring is not elastic.

French Patent No. 2,604,419 concerns a pouch for food having an elastic cord to fit over the contents of the pouch when eating.

U.S. Pat. No. 5,133,607 describes a plastic liner bag which includes elastic drawstrings that are enclosed in the hems at the top of the plastic bag which can be used to both hold the top of the bag on the top of a receptacle as well as to close the bag when filled. The drawstring is preferably formed from a thermoplastic rubber-linear low density polyethylene blend.

SUMMARY OF THE INVENTION

The present invention relates to elastic drawstrings for use in a plastic liner bag. The drawstrings are enclosed in the hems at the top of the bag and can be used to both hold the top of the bag on the top of a receptacle as well as to close the bag when filled. The elastic drawstrings are sealed in the hem provided at the top of the bag in a relaxed state. The top of the bag has perfed notches at each side that break away to expose the ends of the elastic drawstrings on each edge of the bag when the consumer stretches the drawstrings around the top of the receptacle. The drawstrings are then sealed on the ends to form a closed loop elastic drawstring in the hem which has a circumference that is smaller than the circumference of the bag. As such, the closed loop elastic drawstring can be stretched slightly when the hem is folded over a top edge of a receptacle. The closed loop elastic drawstring then contracts to securely hold the top of the bag in place. Because the closed loop drawstring is formed from the elastic drawstrings when in a relaxed state, in its as-formed condition, as well as when it is released from the receptacle, the closed loop drawstring does not close the opening in the top of the bag to a circumference less than that at which the opening is formed.

The closed loop elastic drawstring is also used as a tie strip to close the bag when it is removed from the receptacle. The drawstring thus advantageously provides both a holding force for maintaining the bag in the receptacle and a tie string for closing the bag for closing the bag when removed from the receptacle.

Rather than forming the drawstring from a thermoplastic rubber-linear low density polyethylene blend, as is the preferred method in U.S. Pat. No. 5,133,607, the drawstring of the present invention is formed from a linear low-density polyethylene mixed with polypropylene, preferably a homopolymer polypropylene with a melt index of less than about 1. This mixture improves the modulus and the tensile yield of the drawstring.

The primary object of the present invention is to provide an elastic drawstring with an improved modulus and an improved tensile yield that provides a stronger holding force for maintaining a bag in a receptacle and in a closed position when the bag is removed from the receptacle.

A further object of the invention is to provide a bag having a hem with perfed notches on each side that allows for easier manufacturing of the bag.

Other principal features and objects of the invention will become apparent to those skilled in the art upon review of the following drawings, the detailed description, and the appended claims.

DETAILED DESCRIPTION OF PREFERRED EMBODIMENTS

Figure 1:
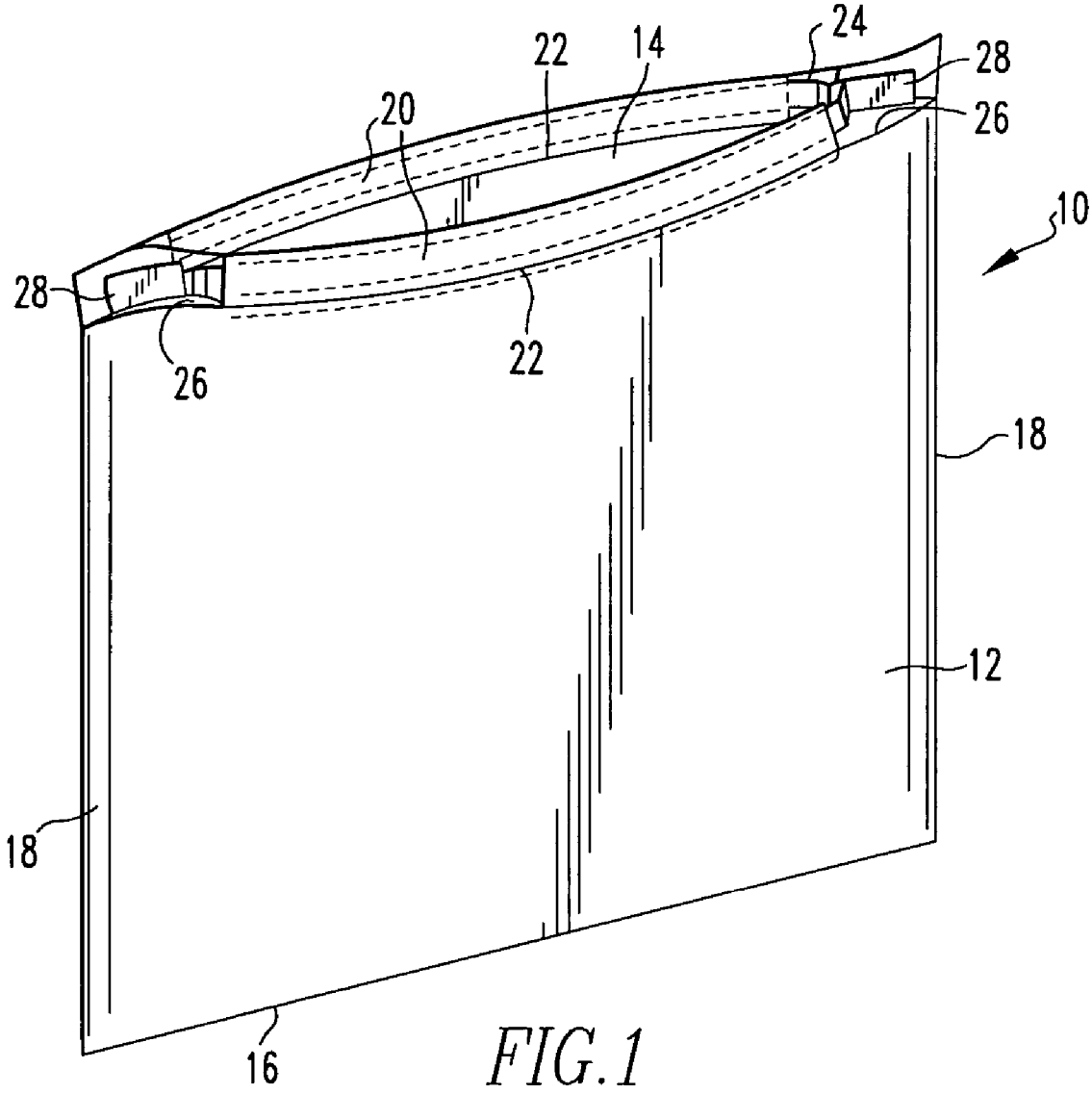
FIG. 1 is a perspective view of the plastic liner bag according to the present invention.

Referring to the drawings, specifically FIG. 1, a plastic liner bag 10 is shown which is suitable for use as a receptacle liner. The bag 10 is made from a film of thermoplastic material. In the preferred embodiment, a polyethylene film is used; however, a wide variety of other plastic films may be used, such as ethylene and polyvinyl acetate copolymers. The thickness of the film will vary depending on the particular thermoplastic material selected and the durability required of the specific application. The film used in the bag will preferably be between 0.0005 and 0.0015 inches thick. Typically, the film exhibits elastic recovery values from 60% to 30% and when elongated from 50% to 300%. The bag 10 generally includes a front 12 and a back 14 which are formed from a single sheet of material that is folded at the bottom 16 and sealed at the edges 18. The top is provided with hems 20 which are folded over and heat sealed to the inside of the front and back sheets along lines 22.

Figure 2:
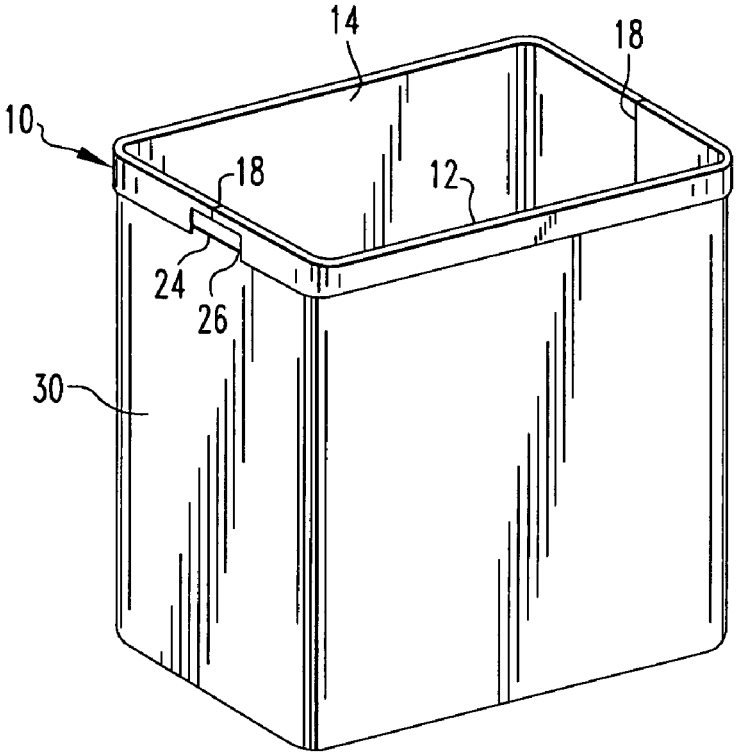
FIG. 2 is a perspective view of the plastic liner bag mounted in a container with the hem turned outward around the top of the container.
Figure 3:
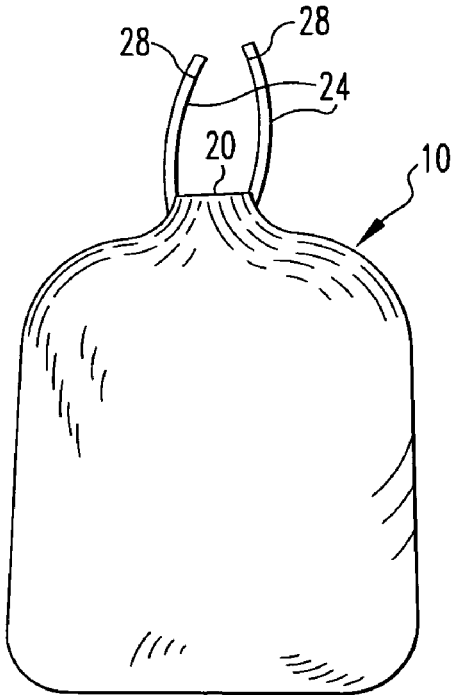
FIG. 3 is a front view of the plastic bag with the closed elastic drawstring used as a tie strip.

In accordance with the present invention, a closed loop elastic drawstring 24 is provided in the hems 20 which can be used both to retain the top of the bag 10 at the top of a receptacle 30, as shown in FIG. 2, as well as a drawstring 24 for closing the bag 10 when filled, as shown in FIG. 3.

The closed loop elastic drawstring 24 can be formed of a thermoplastic rubber, an elastomeric polyolefin material, or a combination therebetween. However, the drawstring 24 of the present invention is formed from a mixture of an elastomeric polyolefin material, specifically a linear low density polyethylene, and polypropylene. A preferred linear low density polyethylene is any material having a melt index of less than about 2, preferably 1, and having a density below about 0.885 g/cc. As density goes down, the elastic behavior of the material is greater. Polyethylene comprises about 65% of the composition of the drawstring. A preferred polypropylene is one with a melt flow rate of less than about 1. Any homopolymer polypropylene or copolymer polypropylene can be used, but a homopolymer is preferred. The amount of polypropylene used in the mixture with polyethylene is less than about 25% of the mixture. The rest of the mixture, about 10%, comprises a slip/antiblock concentrate. For the purposes of this invention, Colortech slip/antiblock concentrate was used, but any suitable slip/antiblock concentrate that will not allow the film to block during extrusion could be used. Colortech slip/antiblock concentrate can be purchased from Colortech Inc. in Morristown, Tenn.

Typically, an elastomeric polyethylene will exhibit excellent elastic recovery values ranging from 85% to 25% when elongated from 50% to 500%. Adding polypropylene reduces the elastic nature of an elastomeric polyethylene to elastic recovery values ranging from 75% to 25% when elongated from 50% to 500%. However, the addition of polypropylene to polyethylene will improve the modulus or stiffness and the tensile yield of the drawstring. These improvements provide for an enhanced drawstring that provides a stronger holding force for maintaining the bag in the receptacle and in a closed position when the bag is removed from the receptacle.

Specifically, an improvement of yield for a 0.007" (7 mil) drawstring was 20-30%. Yield tests can be performed with any commercially available Instron tensile test machine equipped with the appropriate software. Those skilled in the art can also obtain yield values from a stress-strain curve. A 7 mil drawstring is used because the tensile strength of an elastomeric tape material is low compared to high density polyethylene material which is used in current drawstring bags. To maintain the same functionality of the drawstring, a thicker gauge is required. Typical drawstring thickness would be 5-7 mils depending on the material choice of the preferred linear low density polyethylene.

A further dramatic difference between the elastic drawstring described in this invention and the drawstring described in U.S. Pat. No. 5,133,607 is the modulus or stiffness of the material. Typically, a tensile 1% secant modulus test is conducted to determine the stiffness of a drawstring. By definition, the 1% secant modulus is the slope of a stress-strain curve to a 1% strain or extension. Typically, the thermoplastic rubber-linear low density polyethylene blended drawstring described in U.S. Pat. No. 5,133,607 exhibits 1% secant modulus values ranging from 2,000 to 3,000 pounds per square inch. The drawstring of the present invention provides an improvement of 1% secant modulus by as much as about 200-300% or between about 8,000-11,000 pounds per square inch.

The preferred method of making the elastic drawstring is via the blown film process. Cast film process can also be used but these types of materials require non standard extrusion equipment. The formation of the closed loop elastic drawstring 24 is achieved by providing perfed notches 26 at each end of the hems 20 so that the ends break away to expose the ends of the elastic drawstrings 24 on each edge 18 of the bag 10 when the consumer stretches the drawstrings 24 around the top of the receptacle (FIG. 2, 30). The ends of the drawstrings 24 and surrounding hem material 20 are then sealed within 1-2 inches of the edge 18 of the bag 10. The drawstrings and hem material 24, 20 are sealed via heated seal blocks that are typically coated with non-stick materials to avoid the heated polymer from sticking to the heated seal block surface. A closed loop elastic drawstring 24 is thus provided by the elastic drawstrings 24 between the seals 28. Since the seals 28 are located inside of the edges 18, the circumference of the bag 10 is greater than the circumference of the drawstring 24 as the bag 10 is formed. Thus, the liner bag 10 can be fabricated without stretching the closed loop elastic drawstring 24. This is important in reducing production costs as well as in the ability to roll or fold the bag without any special handling, as well as providing a safety feature for a child who may inadvertently place the bag 10 over his head.

Figure 4:
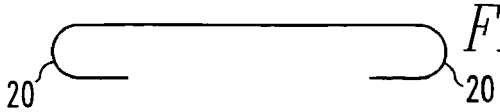
FIG. 4 is a cross-sectional view of the plastic film in continuous motion with a hem forming on each side.
Figure 5:
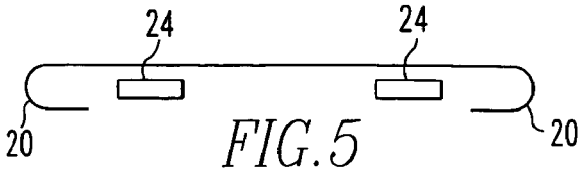
FIG. 5 is a cross-sectional view of the film after a two inch drawstring has been slit into two one inch strips and placed near the hems, which drawstring strips are carried with the web as it moves through the bag making machine.
Figure 6:
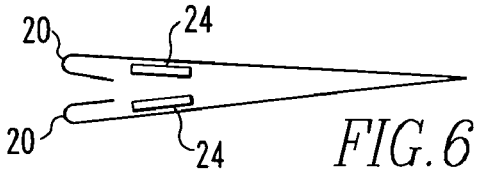
FIG. 6 is a cross-sectional view of the folded web.
Figure 7:
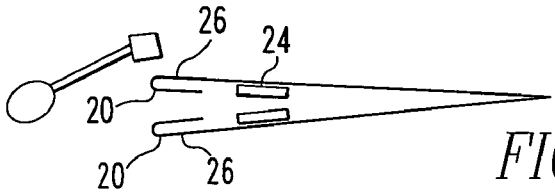
FIG. 7 is a cross-sectional view of the notch formed on each end of the hem, after the web has been converted to intermittent motion after passing through a web drive and dancer system.

The plastic bag 10 can be formed on a bag making line such as an Amplas Sideweld Drawstring Bag Machine made by Amplas, Inc. of Green Bay, Wis. In a machine of this type, the film or sheet of thermoplastic material is shown passing through the hem forming section of the machine where the hems 20 are turned under the film as shown in FIG. 4. The drawstring 24 is then slit from a two inch drawstring into two one inch drawstring strips. These strips are placed near the hems 20 but not completely inside the hems 20, as shown in FIG. 5. This is done so that the notching operation is not interfered with by the drawstrings 24. Alternatively, a collapsed continuous tube (either in roll form or from an in-line blown bubble) can be provided to a suitable bag machine (instead of a web). The tube would be slit on one side so hems can be formed and tape inserted into those hems. The web then passes through a folding section to fold the bag in half, as shown in FIG. 6. Up to this point the web is in continuous motion. Next, the web passes through a web drive and dancer system to convert the web's motion to intermittent. The perfed notches 26 are then created in the hem 20, as shown in FIG. 7, so that when the customer stretches the drawstring 24 around the receptacle, the perf breaks away. The notches 26 are perfed into the hem 20 rather than cut from it to allow for easier manufacturing of the bag. Having the notch 26 attached to the hem 20 allows the thick elastomeric drawstring 24 to track better through the bag machine. The presence of a large open notch causes many difficulties with drawstring tracking within the machine, which results in random bad seals, more scrap, and less output. The perfed notch 26 is created by a perf knife cutter.

Figure 8:
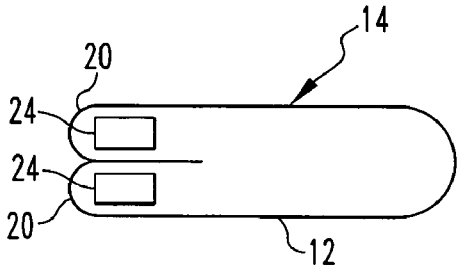
FIG. 8 is a cross-sectional view of the drawstring strips after they have been guided into the hems and sealed on each end in close proximity to the inner edge of the notches near the hems.
Figure 9:
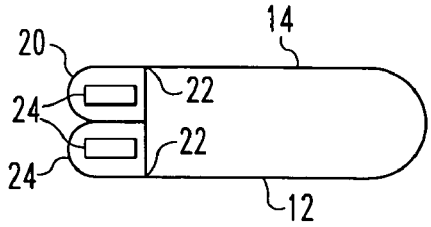
FIG. 9 is a cross-sectional view of the film with the hems sealed.
Figure 10:
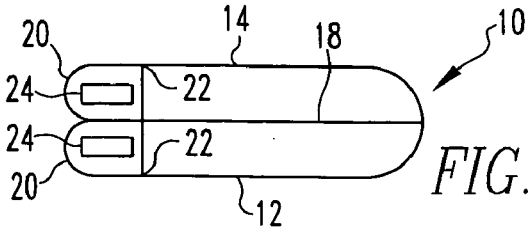
FIG. 10 is a cross-sectional view of the film with the sides welded to form the bag.

FIG. 8 shows the web after the drawstrings 24 have been guided into the hems 20 and sealed in an area in close proximity to the inner edges of the notches near the hems 20. Next, the hems 20 are sealed as the film passes through a longitudinal hem sealer, as shown in FIG. 9. The side edges 22 and ends of the drawstrings 24 are sealed and cut simultaneously to form the bag 10 in the final step, as shown in FIG. 10. It should be noted that this process is continuous and intermittent, but does not interfere with the normal speed of the machine. After the bag 10 is formed, it is passed to a folding machine for folding and packaging.

Having described the presently preferred embodiments, it is to be understood that the invention may be otherwise embodied within the scope of the appended claims.

What is claimed is:

1. A liner bag for a receptacle, the bag comprising:

a plastic sheet folded to form a closed bottom and sealed along each edge to define an open top having a predetermined circumference;

a hem provided on each side at the top of said bag;

an elastic drawstring provided in each hem with ends of said drawstring being joined together to form a closed loop elastic drawstring whereby said closed loop elastic drawstring has a circumference less than the circumference of said top of said bag as said bag is formed and whereby said closed loop elastic drawstring has sufficient elasticity to expand to conform to a top of said receptacle when placed over said receptacle; and a perfed notch provided at each end of the hems, each end of the hems being adapted to breakaway at the perfed notch to expose said closed loop elastic drawstring when said closed loop elastic drawstring is stretched around the top of said receptacle, wherein said elastic drawstring is formed from a mixture including an elastomeric polyolefin and a polypropylene, said elastomeric polyolefin of said drawstring is a linear low density polyethylene, and said liner low density polyethylene is about 65% of said drawstring.

2. A liner bag for a receptacle, the bag comprising:

a plastic sheet folded to form a closed bottom and sealed along each edge to define an open top having a predetermined circumference;

a hem provided on each side at the top of said bag;

an elastic drawstring provided in each hem with ends of said drawstring being joined together to form a closed loop elastic drawstring whereby said closed loop elastic drawstring has a circumference less than the circumference of said top of said bag as said bag is formed and whereby said closed loop elastic drawstring has sufficient elasticity to expand to conform to a top of said receptacle when placed over said receptacle; and a perfed notch provided at each end of the hems, each end of the hems being adapted to breakaway at the perfed notch to expose said closed loop elastic drawstring when said closed loop elastic drawstring is stretched around the top of said receptacle, wherein said elastic drawstring is formed from a mixture including an elastomeric polyolefin and a polypropylene, said polypropylene comprises a homopolymer or copolymer, and said homopolymer or said copolymer has a melt flow rate of less than about 1.

3. A liner bag for a receptacle, the bag comprising:

a plastic sheet folded to form a closed bottom and sealed along each edge to define an open top having a predetermined circumference;

a hem provided on each side at the top of said bag;

an elastic drawstring provided in each hem with ends of said drawstring being joined together to form a closed loop elastic drawstring whereby said closed loop elastic drawstring has a circumference less than the circumference of said top of said bag as said bag is formed and whereby said closed loop elastic drawstring has sufficient elasticity to expand to conform to a top of said receptacle when placed over said receptacle; and a perfed notch provided at each end of the hems, each end of the hems being adapted to breakaway at the perfed notch to expose said closed loop elastic drawstring when said closed loop elastic drawstring is stretched around the top of said receptacle, wherein said polypropylene comprises a homopolymer, said homopolymer has a melt flow rate of less than about 1.

4. A liner bag for a receptacle, the bag comprising:

a plastic sheet folded to form a closed bottom and sealed along each edge to define an open top having a predetermined circumference;

a hem provided on each side at the top of said bag;

an elastic drawstring provided in each hem with ends of said drawstring being joined together to form a closed loop elastic drawstring whereby said closed loop elastic drawstring has a circumference less than the circumference of said top of said bag as said bag is formed and whereby said closed loop elastic drawstring has sufficient elasticity to expand to conform to a top of said receptacle when placed over said receptacle; and a perfed notch provided at each end of the hems, each end of the hems being adapted to breakaway at the perfed notch to expose said closed loop elastic drawstring when said closed loop elastic drawstring is stretched around the top of said receptacle, wherein said elastic drawstring is formed from a mixture including an elastorneric polyolefin and a polypropylene and said polypropylene is less than about 25% of said drawstring.

5. A liner bag for a receptacle, the bag comprising:

a plastic sheet folded to form a closed bottom and sealed along each edge to define an open top having a predetermined circumference;

a hem provided on each side at the top of said bag;

an elastic drawstring provided in each hem with ends of said drawstring being joined together to form a closed loop elastic drawstring whereby said closed loop elastic drawstring has a circumference less than the circumference of said top of said bag as said bag is formed and whereby said closed loop elastic drawstring has sufficient elasticity to expand to conform to a top of said receptacle when placed over said receptacle; and a perfed notch provided at each end of the hems, each end of the hems being adapted to breakaway at the perfed notch to expose said closed loop elastic drawstring when said closed loop elastic drawstring is stretched around the top of said receptacle, wherein said elastic drawstring is formed from a mixture including an elastomeric polyolefin and a polypropylene, and said drawstring is formed from a polypropylene-linear low density polyethylene blend, said blend comprising less than about 65% linear low density polyethylene, less than about 25% polypropylene, and less than about 10% slip/antiblock concentrate.

6. A generally rectangular plastic liner bag for a receptacle, said bag comprising:

a plastic sheet folded to form a closed bottom and sealed along each edge to define an open top having a predetermined circumference;

a hem provided on each side at the top of said bag;

an elastic drawstring provided in each hem with the ends of said drawstring being joined together to form a closed loop elastic drawstring whereby said closed loop elastic drawstring has a circumference less than the circumference of the top of said bag as said bag is formed and whereby said closed loop elastic drawstring has sufficient elasticity to expand to conform to the top of the receptacle when placed over the receptacle and to retract to a circumference less than that of the receptacle when removed from the receptacle but does not retract to a degree to close the top of said bag beyond said predetermined circumference, said elastic drawstring being formed from an elastomeric polyolefin containing a material comprising polypropylene; and a perfed notch provided at each end of the hems, each end of the hems being adapted to breakaway at the perfed notch to expose the closed loop elastic drawstring when the closed loop elastic drawstring is stretched around the top of the receptacle, wherein said elastomeric polyolefin of said drawstring is a liner low density polyethylene, said linear low density polyethylene is about 65% of said drawstring.

7. A generally rectangular plastic liner bag for a receptacle, said bag comprising:

a plastic sheet folded to form a closed bottom and sealed along each edge to define an open top having a predetermined circumference;

a hem provided on each side at the top of said bag;

an elastic drawstring provided in each hem with the ends of said drawstring being joined together to form a closed loop elastic drawstring whereby said closed loop elastic drawstring has a circumference less than the circumference of the top of said bag as said bag is formed and whereby said closed loop elastic drawstring has sufficient elasticity to expand to conform to the top of the receptacle when placed over the receptacle and to retract to a circumference less than that of the receptacle when removed from the receptacle but does not retract to a degree to close the top of said bag beyond said predetermined circumference, said elastic drawstring being formed from an elastomeric polyolefin containing a material comprising polypropylene; and a perfed notch provided at each end of the hems, each end of the hems being adapted to breakaway at the perfed notch to expose the closed loop elastic drawstring when the closed loop elastic drawstring is stretched around the top of the receptacle, wherein said elastomeric polyolefin of said drawstring is a linear low density polyethylene, said polypropylene comprises a homopolymer or copolymer, and said homopolymer or said copolymer has a melt flow rate of less than about 1.

8. A generally rectangular plastic liner bag for a receptacle, said bag comprising:

a plastic sheet folded to form a closed bottom and sealed along each edge to define an open top having a predetermined circumference;

a hem provided on each side at the top of said bag;

an elastic drawstring provided in each hem with the ends of said drawstring being joined together to form a closed loop elastic drawstring whereby said closed loop elastic drawstring has a circumference less than the circumference of the top of said bag as said bag is formed and whereby said closed loop elastic drawstring has sufficient elasticity to expand to conform to the top of the receptacle when placed over the receptacle and to retract to a circumference less than that of the receptacle when removed from the receptacle but does not retract to a degree to close the top of said bag beyond said predetermined circumference, said elastic drawstring being formed from an elastomeric polyolefin containing a material comprising polypropylene; and a perfed notch provided at each end of the hems, each end of the hems being adapted to breakaway at the perfed notch to expose the closed loop elastic drawstring when the closed loop elastic drawstring is stretched around the top of the receptacle, wherein said polypropylene comprises a homopolymer, said homopolymer has a melt flow rate of less than about 1.

9. A generally rectangular plastic liner bag for a receptacle, said bag comprising:

a plastic sheet folded to form a closed bottom and sealed along each edge to define an open top having a predetermined circumference;

a hem provided on each side at the top of said bag;

an elastic drawstring provided in each hem with the ends of said drawstring being joined together to form a closed loop elastic drawstring whereby said closed loop elastic drawstring has a circumference less than the circumference of the top of said bag as said bag is formed and whereby said closed loop elastic drawstring has sufficient elasticity to expand to conform to the top of the receptacle when placed over the receptacle and to retract to a circumference less than that of the receptacle when removed from the receptacle but does not retract to a degree to close the top of said bag beyond said predetermined circumference, said elastic drawstring being formed from an elastomeric polyolefin containing a material comprising polypropylene; and a perfed notch provided at each end of the hems, each end of the hems being adapted to breakaway at the perfed notch to expose the closed loop elastic drawstring when the closed loop elastic drawstring is stretched round the top of the receptacle, wherein said polypropylene is less than about 25% of said drawstring.

* * * * *